US007306310B2

(12) United States Patent
Kuno et al.

(10) Patent No.: US 7,306,310 B2
(45) Date of Patent: Dec. 11, 2007

(54) TECHNIQUE FOR CREATING PRINT DATA UTILIZED BY AN INK JET PRINTER

(75) Inventors: Masashi Kuno, Obu (JP); Toyoshi Inoue, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 59 days.

(21) Appl. No.: 11/277,795

(22) Filed: Mar. 29, 2006

(65) Prior Publication Data

US 2006/0221109 A1 Oct. 5, 2006

(30) Foreign Application Priority Data

Mar. 30, 2005 (JP) ..... 2005-098439

(51) Int. Cl.
*B41J 2/155* (2006.01)

(52) U.S. Cl. ..... 347/15; 358/1.9

(58) Field of Classification Search ..... 347/15, 347/43, 41; 358/1.2, 1.9, 3.2
See application file for complete search history.

(56) References Cited

U.S. PATENT DOCUMENTS 7,118,191 B2 * 10/2006 Fagan et al. ..... 347/41
7,198,347 B2 * 4/2007 Tayuki ..... 347/19
2003/0007024 A1 * 1/2003 Fujimori ..... 347/15
2004/0189727 A1 9/2004 Eguchi et al.

FOREIGN PATENT DOCUMENTS

JP 2004-345167 12/2004

OTHER PUBLICATIONS

Co-pending U.S. Appl. No. 11/281,463, filed Nov. 18, 2005.
Co-pending U.S. Appl. No. 11/285,291, filed Nov. 23, 2005.

* cited by examiner

*Primary Examiner*—Lamson Nguyen
(74) *Attorney, Agent, or Firm*—Banner & Witcoff, Ltd

(57) ABSTRACT

This specification discloses a computer program product for creating print data utilized by an ink jet printer. The ink jet printer comprises an ink jet head moving in a predetermined direction with respect to a print medium. The computer program product includes instructions for ordering a computer to perform a reading step of reading image data that includes a plurality of first combinations. Each first combination comprises a position and information concerning whether a dot is to be formed at the position. The computer program product includes instructions for ordering the computer to further perform a print data creating step of creating the print data by creating a second combination for each position at which the dot is to be formed. Each second combination comprises the position at which the dot is to be formed and one nozzle randomly selected from the nozzles of the nozzle unit which corresponds to the position. In the print data creating step, the same nozzle cannot be selected for more than a predetermined number of positions continuously aligned along the predetermined direction.

7 Claims, 13 Drawing Sheets

TECHNIQUE FOR CREATING PRINT DATA UTILIZED BY AN INK JET PRINTER

CROSS REFERENCE TO RELATED APPLICATION

This application claims priority to Japanese Patent Application No. 2005-098439, filed on Mar. 30, 2005, the contents of which are hereby incorporated by reference into the present application.

BACKGROUND OF THE INVENTION

1. Field of the Invention

The present invention relates to a technique for forming print data utilized by an ink jet printer. The ink jet printer of the present specification includes all devices for printing onto a print medium by means of discharging ink (printers, copiers, fax machines, multifunctional products, etc.).

2. Description of the Related Art

Ink jet printers print onto a print medium by means of discharging ink The manner in which printing is performed by an ink jet printer will be described with reference to FIG. 18. An ink jet printer 151 has an ink jet head 152 that moves with respect to a print medium 150. In FIG. 18, the ink jet head 152 moves in a Y direction with respect to the print medium 150. The ink jet head 152 passes a front side of the print medium 150. The ink jet head 152 has a plurality of nozzles 153~157. The nozzles 153~157 are aligned in an X direction that is orthogonal to the Y direction. The nozzles 153~157 can discharge ink droplets in the direction perpendicular to the page.

The ink droplets are discharged from the nozzles 153~157 while the ink jet head 152 is moving with respect to the print medium 150. One dot is formed on the print medium 150 by discharging one or a plurality of ink droplets from one nozzle. In FIG. 18, 35 dots have been formed on the print medium 150. The dots aligned in the Y direction have been formed by one nozzle. For example, a dot line D1 has been formed by continuously discharging ink droplets from the nozzle 153. Similarly, a dot line D2 has been formed by the nozzle 154, a dot line D3 has been formed by the nozzle 155, a dot line D4 has been formed by the nozzle 156, and a dot line D5 has been formed by the nozzle 157.

The nozzles 153~157 might not be equidistant in the X direction. In the example of FIG. 18, the nozzle 155 is slightly displaced toward the right. In this case, the dot line D3 is formed slightly displaced toward the right The dot line D2 and the dot line D3 barely overlap, and there is a large overlap of the dot line D3 and the dot line D4. In this case, ink density between the dot line D2 and the dot line D3 is much less than in other portions. The region in which the ink density is smaller extends continuously in the Y direction. Further, the ink density between the dot line D3 and the dot line D4 is much greater than in other portions. The region in which the ink density is greater extends continuously in the Y direction. When the region in which the ink density is smaller or greater extends continuously in the Y direction, a user can perceive a striped pattern that extends in the Y direction. Printing results are thus unsatisfactory.

The technique set forth in Japanese Patent Application Publication No. 2004/345167 will be described with reference to FIG. 19. An ink jet head 202 of an ink jet printer 201 has a plurality of nozzle units 203~207. The nozzle unit 203 has a pair of nozzles 203*a* and 203*b* that are aligned in a direction (a Y direction) in which the ink jet head 202 moves with respect to a print medium 200. The other nozzle units 204~207 each have a configuration similar to the configuration of the nozzle unit 203. That is, the nozzle units 204~207 have nozzles 204*a*~207*a* and nozzles 204*b*~207*b*. The nozzles 203*a*~207*a* and nozzles 203*b*~207*b* can discharge the same color ink.

The nozzle unit 203 can form one dot on the print medium by discharging ink droplets from either of the nozzles 203*a* and 203*b*. The other nozzle units 204~207 can also form one dot on the print medium by discharging ink droplets from either of the nozzles.

With the technique of FIG. 19, an external device (for example, a PC) connected with the ink jet printer 201 selects one nozzle at random from the nozzles of the nozzle unit which corresponds to the position at which the dot is to be formed.

For example, if the position at which a dot is to be formed is P11, one nozzle (the nozzle 203*a* or the nozzle 203*b*) is selected at random from the nozzle unit 203 that corresponds to P11. In the case where the external device has selected the nozzle 203*a*, the external device creates information including the combination of P11 and the nozzle 203*a*.

As another example, if the position at which a dot is to be formed is P12, one nozzle is selected at random out of the nozzles 203*a* and 203*b*. In the case where the external device has selected the nozzle 203*b*, the external device creates information including the combination of P12 and the nozzle 203*b*.

As another example, if the position at which a dot is to be formed is P21, one nozzle (the nozzle 204*a* or the nozzle 204*b*) is selected at random from the nozzle unit 204 that corresponds to P21. In the case where the external device has selected the nozzle 204*b*, the external device creates information including the combination of P21 and the nozzle 204*b*.

The external device creates data that includes a plurality of combinations of position and nozzle. Below, this data will be termed print data. The external device outputs the print data to the ink jet printer 201. The ink jet printer 201 discharges ink from the nozzles based on the print data. For example, in the case where print data has been obtained having the combination of P11 and the nozzle 203*a*, the ink jet printer 201 discharges ink from the nozzle 203*a* toward P11. As another example, in the case where print data has been obtained having the combination of P12 and the nozzle 203*b*, the ink jet printer 201 discharges ink from the nozzle 203*b* toward P12. As another example, in the case where print data has been obtained having the combination of P21 and the nozzle 204*b*, the ink jet printer 201 discharges ink from the nozzle 204*b* toward P21.

In FIG. 19, hatching has been applied to the dots formed by the nozzles 203*a*~207*a* Hatching has not been applied to the dots formed by the nozzles 203*b*~207*b*.

In the nozzle line D3 of FIG. 19, the dots formed by the nozzle 205*a* are displaced toward the right. The dots formed by the nozzle 205*b* are not displaced. The dots of the other nozzle lines D1, D2, D4, and D5 are also not displaced.

With this technique, if the nozzle 205*a* is not aligned equidistantly in the X direction, the dot line D3 will not be formed only by the nozzle 205*a*, but will instead be formed by both the nozzle 205*a* and the nozzle 205*b*. As a result, some dots in the dot line D3 are not displaced. With this technique, it may be possible to prevent in which the ink density is much greater or smaller from continuing across a wide range. Better printing results can be obtained with this technique than with the conventional technique described using FIG. 18.

BRIEF SUMMARY OF THE INVENTION

In the conventional technique described using FIG. 19, one nozzle is selected at random from among the plurality of nozzles for the position where the dot is to be formed. In this case, there is a possibility that the same nozzle will be selected continuously for a large number of positions continuously aligned along the Y direction. With this technique, therefore, it is not possible to completely eliminate the phenomenon wherein regions in which the ink density is much greater or smaller continue across a wide range There is a possibility that satisfactory printing results cannot be obtained.

The present invention has been created taking the above conditions into consideration. The present invention teaches a technique that allows better printing results to be obtained than the conventional technique.

The present invention relates to a technique for creating print data utilized by an ink jet printer. The print data creating technique of the present invention will be described using FIG. 1.

In the present invention, print data is created that is utilized by an ink jet printer 301 provided with the following conditions.

(1) The ink jet printer 301 has an ink jet head 302 that moves along a predetermined direction (a Y direction in FIG. 1) with respect to a print medium 300.

(2) The ink jet head 302 has a plurality of nozzle units 303~307.

(3) The nozzle units 303~307 each have at least two nozzles aligned in the aforementioned predetermined direction. For example, the nozzle unit 303 has nozzles 303*a* and 303*b*. The other nozzle units 304~307 each have at least two nozzles 304*a*~307*a* and 304*b*~307*b*.

(4) The nozzles 303*a*~307*a* and 303*b*~307*b* can discharge the same color ink.

(5) Each nozzle unit 303~307 can create a dot on the print medium 300 by discharging ink from one nozzle (for example 303*a*) selected out of the nozzles (for example, 303*a* and 303*b*) of the nozzle unit (for example, 303).

A computer program product for creating print data is taught in the present invention. This computer program product includes instructions for ordering a computer to perform a reading step and a print data creating step.

In the reading step, image data including a plurality of first combinations is read. Each of the first combinations includes a position and information hereafter termed dot information) concerning whether a dot is to be formed at the position. For example, 35 positions P11, P12, P13, etc. are shown in FIG. 1. In the case of FIG. 1, the image data including the 35 first combinations are read in the reading step. Further, in this example, dots are to be formed at all positions except for P13.

In the print data creating step, print data is created by creating a second combination for each position at which the dot is to be formed. In the example of FIG. 1, the second combinations are created for the positions P11, P12, etc. Since P13 is a position at which a dot is not to be formed, a second combination is not created for P13. Each of the second combinations includes the position at which the dot is to be formed, and one nozzle randomly selected from the nozzles of the nozzle unit corresponding to the position. For example, the second combination for P11 is a combination including P11 and one nozzle (303*a* or 303*b*) randomly selected from the nozzles 303*a* and 303*b* of the nozzle unit 303 corresponding to P11. Further, the second combination for P21 is a combination including P21 and one nozzle (304*a* or 304*b*) randomly selected from the nozzles 304*a* and 304*b* of the nozzle unit 304 corresponding to P21.

Moreover, in the print data creating step, it is prohibited to select the same nozzle for more than a predetermined number of positions continuously aligned along the predetermined direction (the Y direction). For example, if the predetermined number is two, the same nozzle cannot be selected for three or more positions aligned continuously along the Y direction. In this case, for example, the same nozzle (for example 303*a*) cannot be selected for P14, P15, and P16.

The print data created by the present invention is utilized by the ink jet printer 301. When the ink jet printer 301 obtains, for example, the second combination of P11 and the nozzle 303*a*, the ink jet printer 301 causes ink to be discharged from the nozzle 303*a* towards P11, and a dot is thus formed. In FIG. 1 (*c*), 34 dots formed by the ink jet printer 301 are shown. A dot is not formed at the position corresponding to P13. This is because P13 is not a position where a dot is to be formed in this example.

In FIG. 1 (*c*), hatching has been applied to the dots formed by the nozzles 303*a* 307*a* Hatching has not been applied to dots formed by the nozzles 303*b*~307*b*.

Dots formed by the nozzle 305*a* are displaced toward the right in a nozzle line D3. The dots formed by the nozzle 305*b* are not displaced. The dots of the other nozzle lines D1, D2, D4, and D5 are also not displaced With this technique, if the nozzle 305*a* is not aligned equidistantly in the X direction, the dot line D3 will be formed by both the nozzle 305*a* and the nozzle 305*b*. As a result, displacement of all of the dots in the dot line D3 is prevented. Moreover, in the print data creating step, the same nozzle cannot be selected for more than a predetermined number of positions aligned continuously along the Y direction. As a result dots cannot be formed by the same nozzle for more than the predetermined number of positions aligned continuously along the Y direction. With this technique, it is possible to completely eliminate the phenomenon wherein regions in which the ink density is much greater or smaller continue across a wide range. With the present invention, it is possible to create print data that allows better printing results than the conventional technique.

The content of FIG. 1 and the description based thereon is an example, and a scope of the present invention is not restricted based on FIG. 1 or the above content. The scope of the present invention is determined objectively based on the teachings of the claims.

BRIEF DESCRIPTION OF THE DRAWINGS

FIG. 1 (*a*) shows a plan view of a portion of an ink jet head. FIG. 1 (*b*) shows positions on printing paper FIG. 1 (*c*) shows an example of a dot pattern formed on the printing paper.

FIG. 5 is a figure for describing how ink is discharged from two nozzle lines.

DETAILED DESCRIPTION OF THE INVENTION

Embodiment

Figure 2:
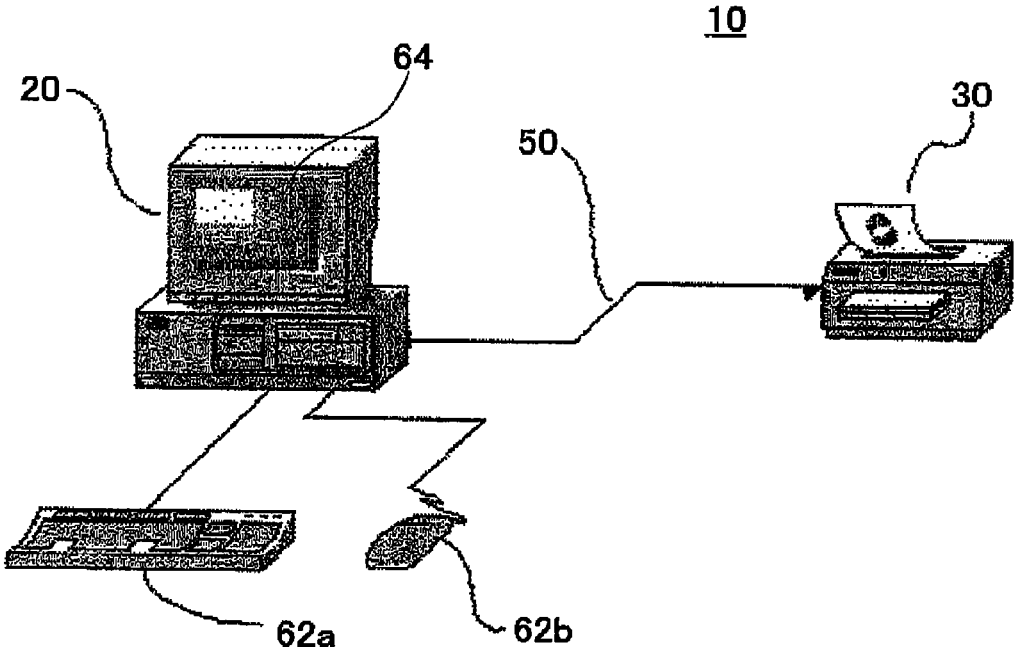
FIG. 2 is a simple view of a printing system of an embodiment.

An embodiment of the present invention will be described with reference to figures. FIG. 2 is a simple view of a printing system 10 of the present embodiment. The printing system 10 has a PC 20 and an ink jet printer 30. Below, the ink jet printer 30 may be simply referred to as 'printer 30'. The PC 20 and the printer 30 are connected so as to be capable of communication via a communication cable 50.

The PC 20 has a keyboard 62*a*, a mouse 62*b*, a display 64, etc. A user can utilize the keyboard 62*a* and the mouse 62*b* to command the PC 20 to print content displayed on the display 64. In this case, the PC 20 creates print data, and outputs the print data that has been created to the printer 30.

The printer 30 inputs the print data that was output from the PC 20. The printer 30 has an ink jet head 32 (shown in FIG. 3) capable of discharging ink. The printer 30 discharges ink from the ink jet head 32 towards printing paper 12 (shown in FIG. 3) in accordance with the content of the print data. Letters or images are thus printed on the printing paper 12 based on the content of the print data.

Figure 3:
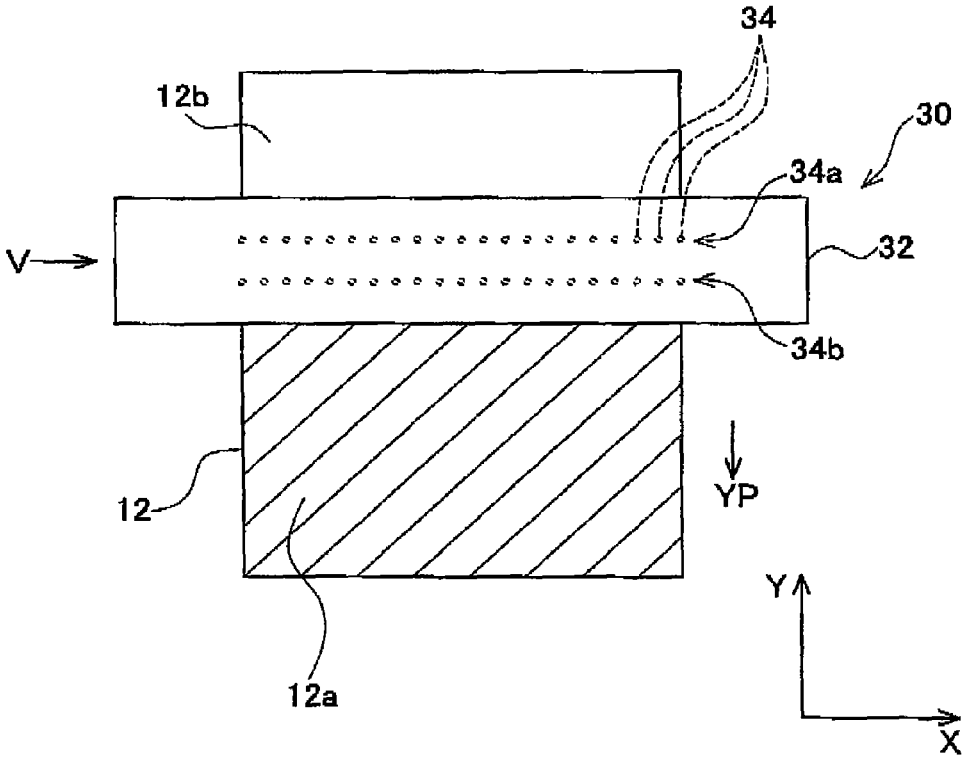
FIG. 3 is a simple plan view of an ink jet head.

FIG. 3 is a plan view of the ink jet head 32. The printer 30 has a transferring device 104 (shown in FIG. 7) for transporting the printing paper 12 in the direction of the arrow YP. That is, the ink jet head 32 moves in the direction of the arrow Y with respect to the printing paper 12. The printing paper 12 passes a back side of the ink jet head 32 perpendicular to the plane of FIG. 3.

The ink jet head 32 has two nozzle lines 34*a* and 34*b*. The nozzle lines 34*a* and 34*b* includes a plurality of nozzles 34. In FIG. 3, not all of the nozzles 34 have numbers applied thereto. The nozzle lines 34*a* and 34*b* extend in an X direction. The X direction is a direction perpendicular to the Y direction. The length of the X direction of the nozzle lines 34*a* and 34*b* is approximately the same as the width in the X direction of the printing paper 12. The nozzles 34 can discharge ink of the same color (black, for example) in the direction perpendicular to the plane of FIG. 3.

The ink jet head 32 discharges ink while the printing paper 12 is being transported. A hatched region 12*a* of the printing paper 12 is a region that has been printed by the ink jet head 32. A region 12*b* of the printing paper 12 that has not been hatched is a region that has not yet been printed by the ink jet head 32.

In the present embodiment, the ink jet head 32 is fixed to a printer main body (not shown). That is, the printer 30 is a line type printer.

Figure 4:
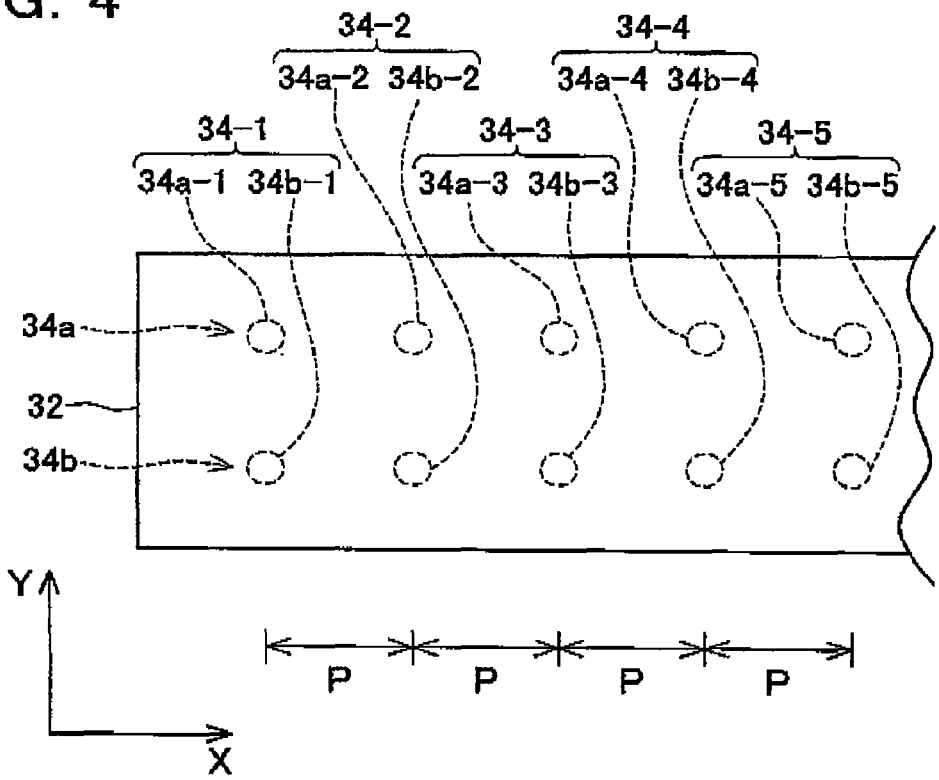
FIG. 4 is an enlarged view of a part of the ink jet head.

FIG. 4 is an enlarged view of a part of the ink jet head 32. In the present embodiment, a pair of nozzles aligned in the Y direction will be termed a nozzle unit. Five nozzle units 34-1~34-5 are shown in FIG. 4. In fact, more nozzle units are formed in the ink jet head 32. The nozzle units 34-1~34-5 are offset in the X direction.

The nozzle unit 34-1 has a pair of nozzles 34*a*-1 and 34*b*-1 aligned in the Y direction. Similarly, the other nozzle units 34-2~34-5 each also have a pair of nozzles (34*a*-2~34*a*-5, 34*b*-2~34*b*-5) aligned in the Y direction. Two adjacent nozzle units (for example, 34-1 and 34-2) are separated by a predetermined pitch P.

Figure 5:
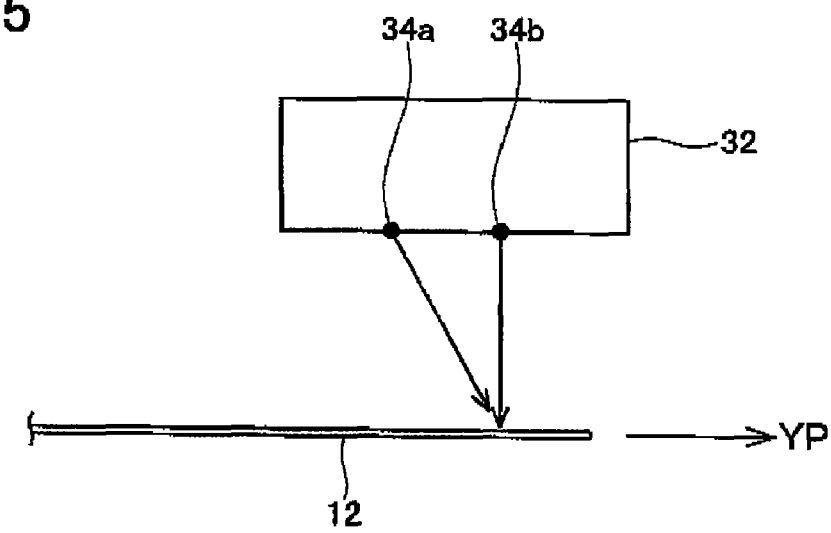
FIG. 5 is a view in the V direction of FIG. 3.

FIG. 5 is a view of the ink jet head 32 in the V direction of FIG. 3. The nozzles (for example 34*a*-1) of the nozzle line 34*a* discharge ink in an oblique direction towards the nozzle line 34*b*. The nozzles (for example 34*b*-1) of the nozzle line 34*b* discharge ink in a vertical direction If the pair of nozzles (for example, 34*a*-1 and 34*b*-1) of one nozzle unit (for example, 34-1) discharge ink with the same timing, the ink adheres to the same position. Each of the nozzle units (for example, 34-1) can form one dot by discharging ink from either nozzle (for example, 34*a*-1 or 34*b*-1).

Figure 1:
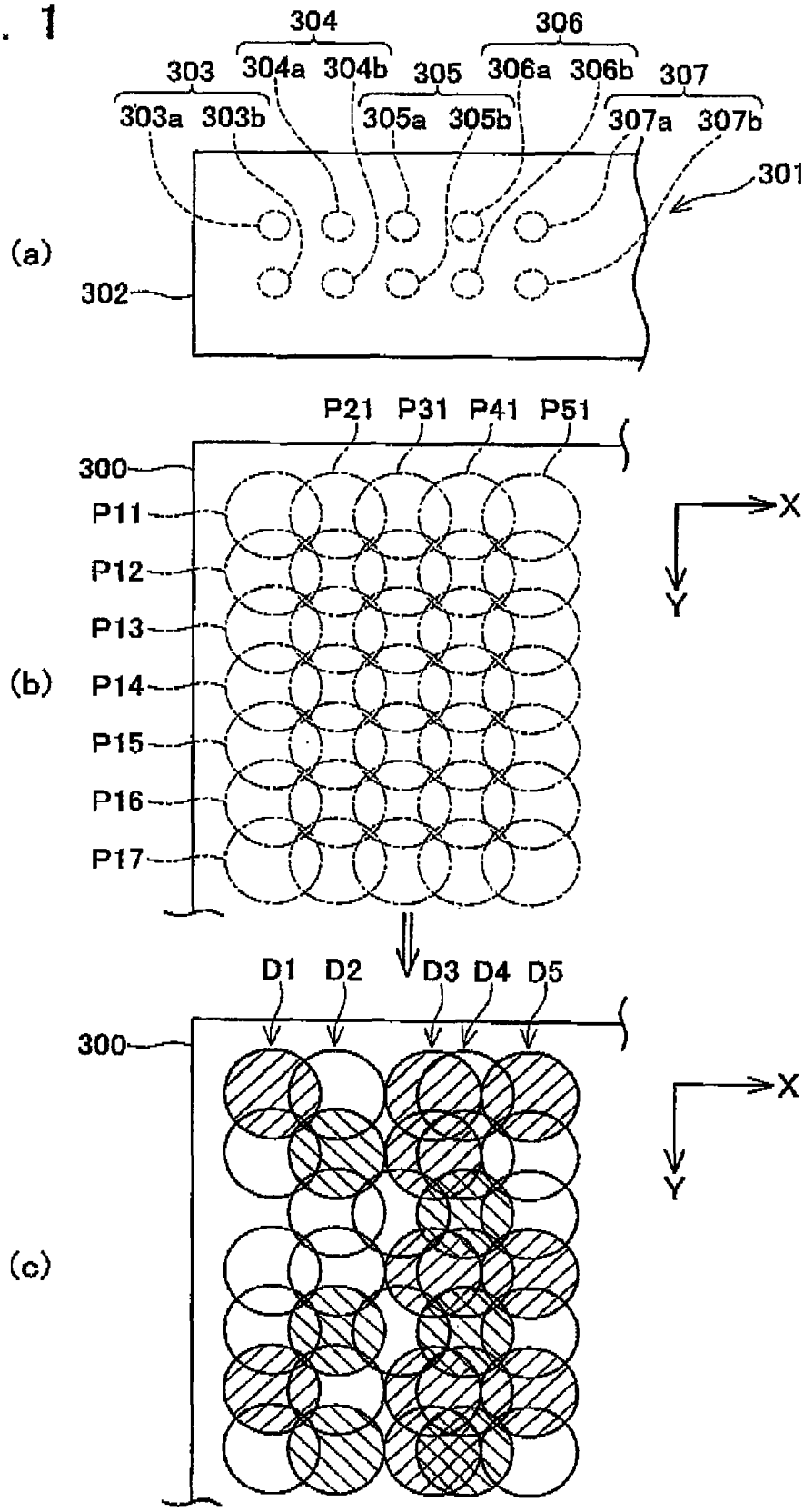
FIG. 1 shows a figure for describing the content of the present invention.

One nozzle unit (for example, 34-1) forms one dot line (for example, D1 in FIG. 1). One dot line includes a plurality of dots aligned in the Y direction.

Figure 6:
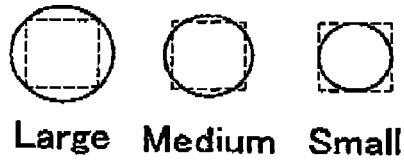
FIG. 6 shows three dots with differing sizes.

Further, the ink jet printer 30 can vary the quantity of ink for forming one dot. A large dot is formed when the ink quantity is large. A small dot is formed when the ink quantity is small. A medium dot is formed when the ink quantity is medium. FIG. 6 shows three dots with differing sizes. Each nozzle can form large dots, medium dots, and small dots. As a result, the printer 30 of the present embodiment can describe four gradations (large dot, medium dot, small dot, and no dot).

Figure 7:
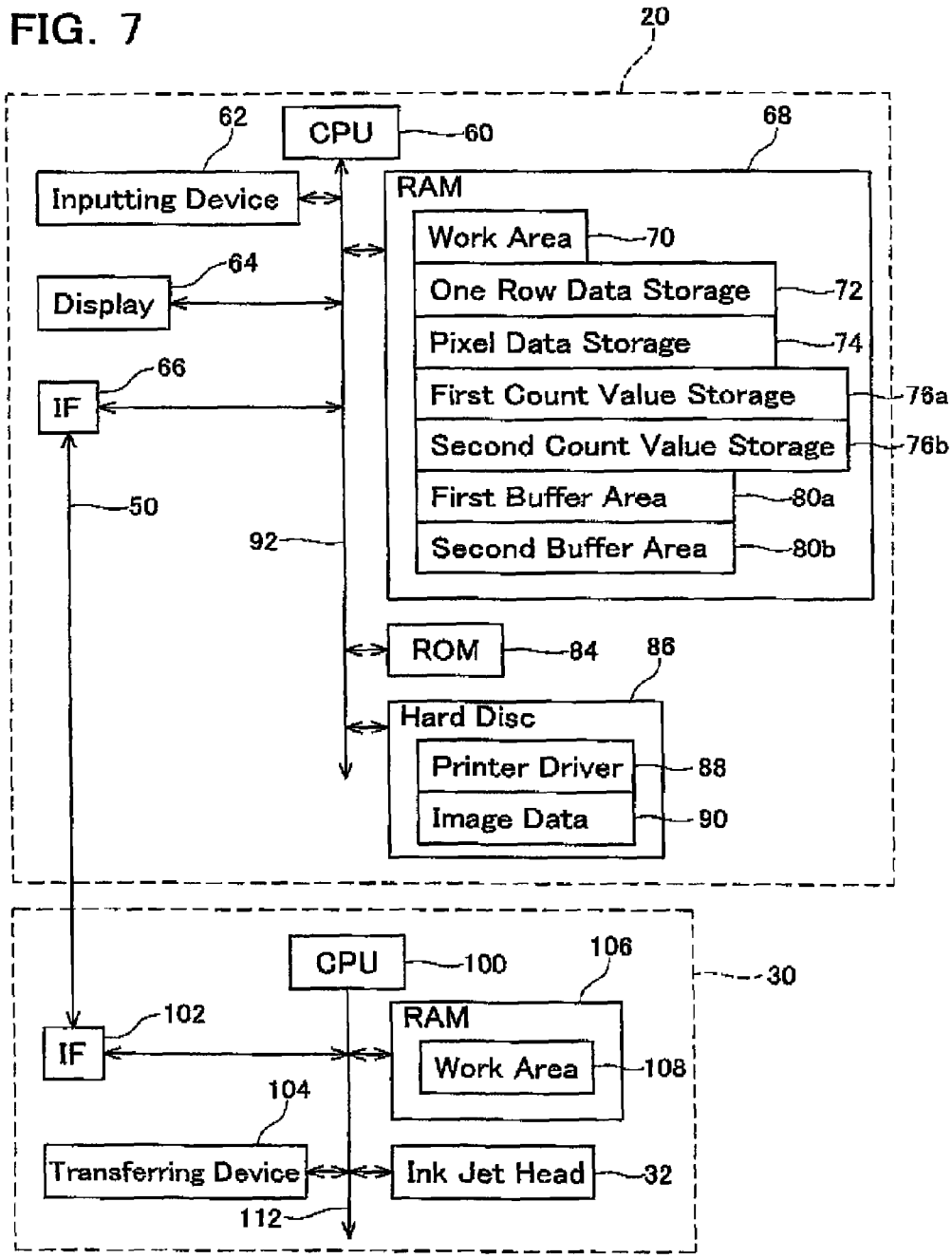
FIG. 7 shows a block view of a PC and a printer.

FIG. 7 shows a block view of the PC 20 and the printer 30. First, the configuration of the PC 20 will be described.

The PC 20 has a CPU 60, an inputting device 62, the display 64, an interface (IF) 66, a RAM 68, a ROM 84, a hard disc 86, etc. Each of the devices 60, 62, etc. are connected so as to be capable of communication by a bus line 92.

The CPU 60 reads and executes a printer driver 88 stored in the hard disc 86.

The inputting device 62 includes the keyboard 62*a* and the mouse 62*b* shown in FIG. 2. The user can input information utilizing the inputting device 62. For example, the user can input information for causing the printer 30 to print content displayed by the display 64.

The display 64 can display information created by various applications.

The IF 66 is connected with an IF 102 of the printer 30. The IF 66 outputs the print data to the printer 30.

The RAM 68 has a work area 70, a one row data storage 72, a pixel data storage 74, a first count value storage 76*a*, a second count value storage 76*b*, a first buffer area 80*a*, a second buffer area 80*b*, etc.

The work area 70 is a storage utilized when the printer driver 88 is being executed.

The storages 72, 74, 76*a*, 76*b*, 80*a*, and 80*b* are storages utilized in a print data creating process (to be described).

Figure 8:
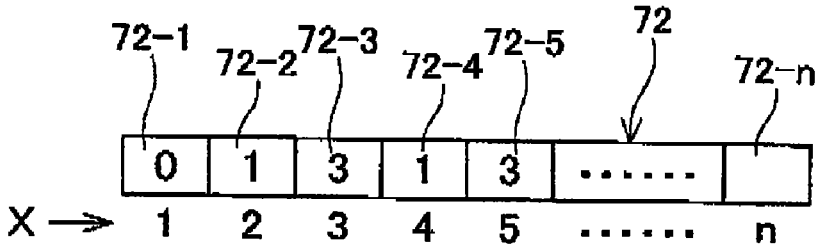
FIG. 8 shows a one row data storage.

FIG. 8 shows the one row data storage 72. The one row data storage 72 has a plurality of cells 72-1~72-*n* (n being a positive integer). The one row data storage 72 stores gradation values of one row's worth of data (one row data) included in image data. Each cell can store any of the values 0, 1, 2, 3. The number of cells corresponds to the resolution of the printer 30 in the X direction (see FIG. 3, etc.). That is, the number of cells is the same as the number of nozzle units. One cell 72-*n* corresponds to one nozzle unit 34-*n*. For example, the cell 72-1 corresponds to the nozzle unit 34-1. As another example, the cell 72-5 corresponds to the nozzle unit 34-5. The manner in which the one row data storage 72 is utilized will be described in detail later.

The pixel data storage 74 shown in FIG. 7 stores data for one cell (pixel) included in the one row data. The manner in which the pixel data storage 74 is utilized wilt be described in detail later.

Figure 9:
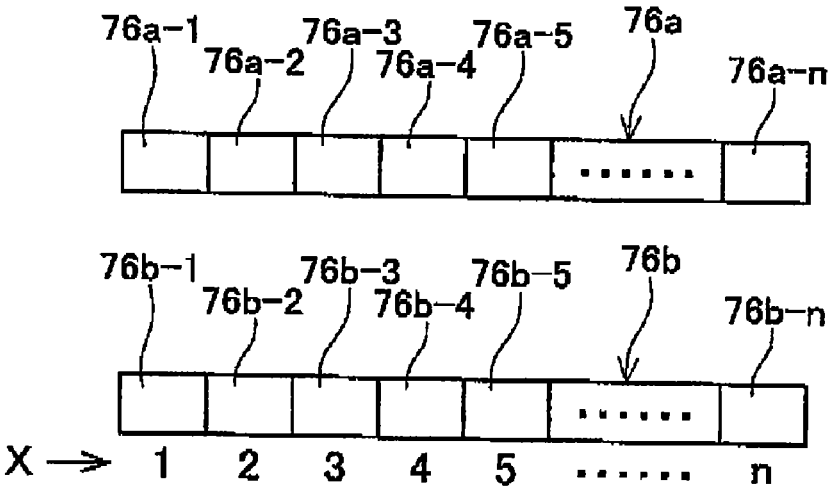
FIG. 9 shows count value storages.

FIG. 9 shows the first count value storage 76*a* and the second count value storage 76*b*. The first count value storage 76*a* has a plurality of cells 76*a*-1~76*a*-*n*. The number of cells of the first count value storage 76*a* corresponds to the resolution of the printer 30 in the X direction. The cell 76*a*-*n* corresponds to the nozzle 34*a*-*n*. The first count value storage 76*a* stores a count value for each of the nozzles 34*a*-1~34*a*-*n* included in the nozzle line 34*a*. The cell 76*a*-*n* stores a count value of the corresponding nozzle 34*a*-*n*. The count value will be described in detail later. Each cell of the first count value storage 76*a* can store any of the values 0, 1, 2.

The second count value storage 76*b* has a plurality of cells 76*b*-1~76*b*-*n*. The number of cells of the second count value storage 76*b* corresponds to the resolution of the printer 30 in the X direction. The cell 76*b*-*n* corresponds to the nozzle 34*b*-*n*. The second count value storage 76*b* stores a count value for each of the nozzles 34*b*-1~34*b*-*n* included in the nozzle line 34*b* (see FIG. 4, etc.). The cell 76*b*-*n* stores a count value of the corresponding nozzle 34*b*-*n*. Each cell of the second count value storage 76*b* can store any of the values 0, 1, 2.

Figure 10:
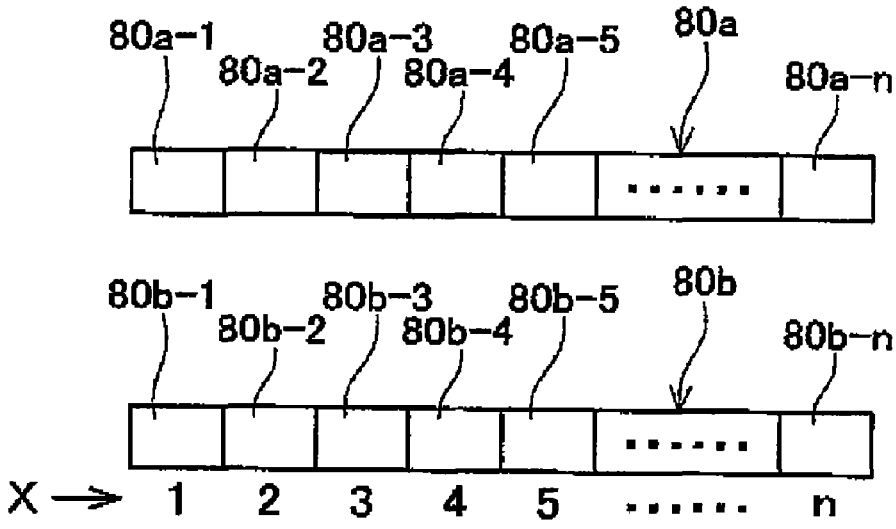
FIG. 10 shows buffer areas.

FIG. 10 shows the first buffer area 80*a* and the second buffer area 80*b*. The first buffer area 80*a* has a plurality of cells 80*a*-1~80*a*-*n*. The number of cells of the first buffer area 80*a* corresponds to the resolution of the printer 30 in the X direction. The cell 80*a*-*n* corresponds to the nozzle 34*a*-*n*. Each cell of the first buffer area 80*a* can store any of the values 0, 1, 2, 3.

The second buffer area 80*b* has a plurality of cells 80*b*-1~80*b*-*n*. The number of cells of the second buffer area 80*b* corresponds to the resolution of the printer 30 in the X direction. The cell 80*b*-*n* corresponds to the nozzle 34*b*-*n*. Each cell of the second buffer area 80*b* can store any of the values 0, 1, 2, 3.

Although this will be described in detail later, the content of the first row data is sorted into the first buffer area 80*a* or the second buffer area 80*b*.

The ROM 84 of FIG. 7 stores programs for controlling the CPU 60.

The hard disc 86 stores the printer driver 88. The user installs media included as an auxiliary component of the printer 30 on the PC 20. A program causing the PC 20 to execute processes (to be described: see FIGS. 12, 14, 15) is stored in the media. When this program has been installed on the PC 20, the printer driver 88 can function. The processes to be described are executed by the printer driver 88. The hard disc 86 also stores image data 90. The user can input information to the inputting device 62 so that the image data 90 is printed by the printer 30.

Figure 11:
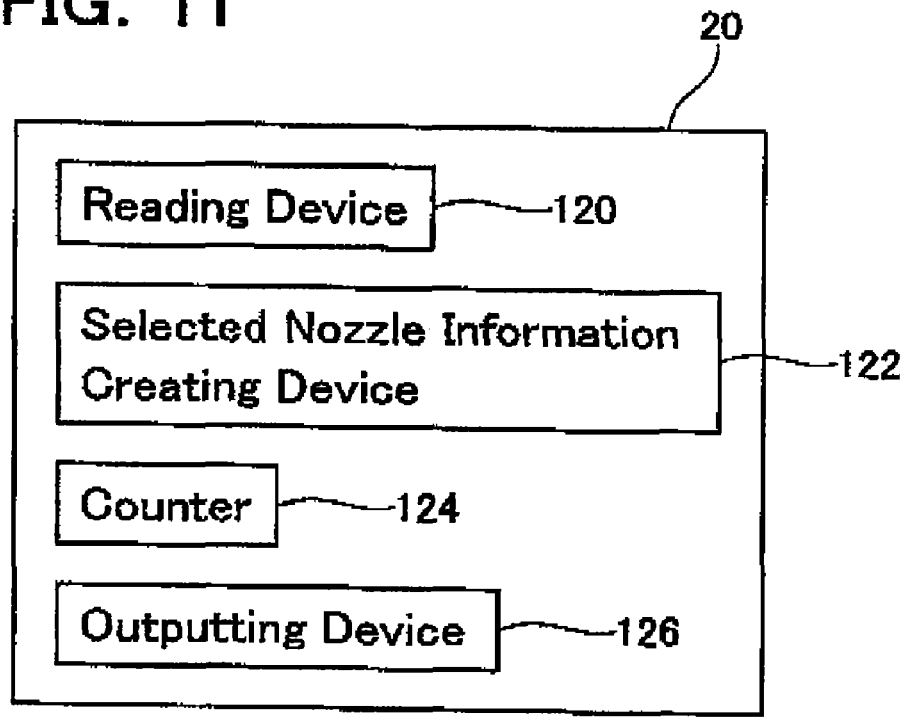
FIG. 11 shows functions realized by the PC.

The PC 20 realizes various functions by means of the above devices 60~86. FIG. 11 shows an example of functions realized by the PC 20. The PC 20 has a reading device 120, a selected nozzle information creating device (a print data creating device) 122, a counter 124, and an outputting device 126.

The reading device 120 reads the image data 90. The reading device 120 functions when the processes of FIG. 14 and FIG. 15 (to be described) are to be executed. The reading device 120 is realized by the functioning of the CPU 60, the one row data storage 72, etc.

The selected nozzle information creating device 122 creates selected nozzle information (print data). The selected nozzle information creating device 122 functions when the processes of FIG. 14 and FIG. 15 (to be described) are to be executed. Else selected nozzle information creating device 122 is realized by the functioning of the CPU 60, the RAM 68, the ROM 84, the printer driver 88, etc.

The counter 124 stores count values of nozzle units 34, etc. The counter 124 functions when the process of FIG. 14 and FIG. 15 (to be described) are to be executed. The counter 124 is realized by the functioning of the CPU 60, the count value storages 76*a* and 76*b*, etc.

The outputting device 126 outputs the selected nozzle information (the print data) that has been created to the printer 30. The outputting device 126 functions when the processes of FIG. 14 and FIG. 15 (to be described) are to be executed. The outputting device 126 is realized by the functioning of the CPU 60, the IF 66, etc.

Next, the configuration of the printer 30 will be described.

The printer 30 has a CPU 100, the IF 102, the transferring device 104, a RAM 106, the ink jet head 32, etc. The devices 100, 102, etc. are connected so as to be capable of communication by a bus line 112.

The CPU 100 controls the transferring device 104 and the ink jet head 32 based on commands from the PC 20.

The IF 102 is connected with the IF 66 of the PC 20. The IF 102 inputs print data sent from the PC 20.

The transferring device 104 moves the printing paper 12 (see FIG. 3) in the direction of the arrow YP.

The ink jet head 32 prints the printing paper 12 by discharging ink.

The RAM 106 has a work area 108 for operating the CPU 100.

In the present embodiment, the hardware configuration of the ink jet printer 30 is explained in an extremely simple manner. The configuration of the ink jet printer 30 is taught in, for example, U.S. patent application Ser. No. 11/281,463 and 11/285,291. The contents of U.S. Ser. No. 11/281,463 and U.S. Ser. No. 11/285,291 may be incorporated by reference into the present application.

Figure 12:
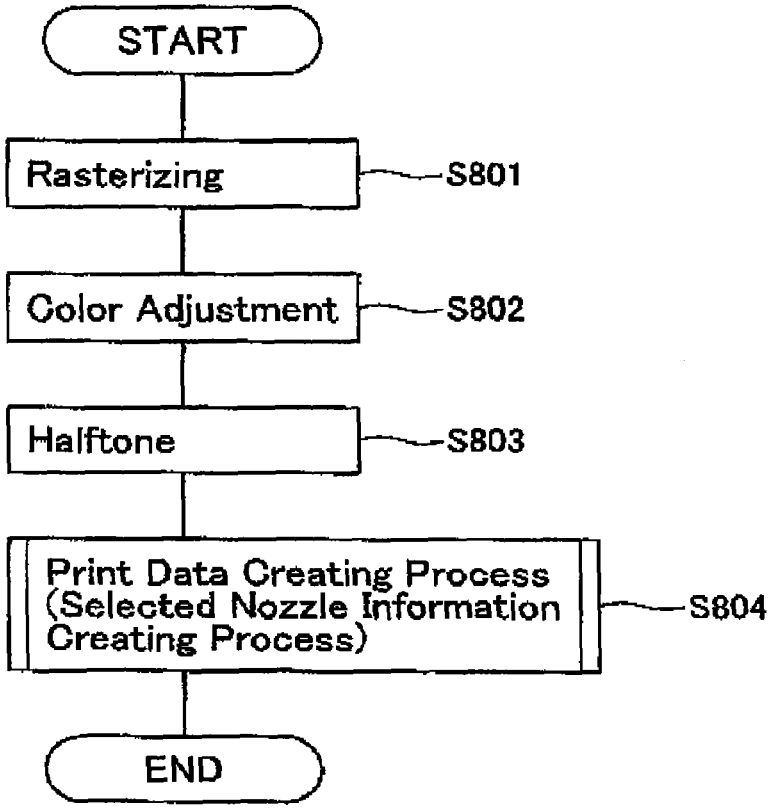
FIG. 12 shows a flowchart of printing processes executed by the PC.

Next, the processes executed by the PC 20 will be described with reference to the flowchart of FIG. 12. FIG. 12 shows a flowchart showing the processes executed by the PC 20. The processes of FIG. 12 are executed by the CPU 60 (see FIG. 7) utilizing the printer driver 88.

The user can use the inputting device 62 (see FIG. 7) to command the image data 90 being stored in the hard disc 86 to be printed. In this case, the CPU 60 activates the printer driver 88, and executes a rasterizing process (S801).

The image data 90 prior to the execution of the rasterizing process is displayed in a vector format. In the rasterizing process, the image data 90 in the vector format is converted to data in a bit mapped format. The image data 90 is converted to data that conforms with the resolution of the printer 30. The image data 90 in the bit mapped format contains information for a plurality of pixels. One pixel is represented by data having the combination of the position (coordinate on the printing paper) and the gradation at that position In the image data 90 in the bit mapped format, one pixel is represented by 256 gradations (8 bits) or 6553 gradations (16 bits). The image data 90 after the rasterizing process is stored in the work area 70 of the RAM 68.

Next, the CPU 60 executes a color adjustment process (S802). In the color adjustment process, the colors for the image data 90 are corrected. Further, ROB data is converted into CMYK data. The image data 90 after the color adjustment process is stored in the work area 70 of the RAM 68. The image data 90 prior to the color adjustment process is erased from the RAM 68.

The CPU 60 executes a halftone process (S803). As described above, with the image data 90 after the rasterizing process, one pixel is represented by 256 gradations or 6553 gradations. By contrast, the printer 30 of the present embodiment can only represent four gradations (large dot, medium dot, small dot, and no dot) for one pixel (i.e. for one position). In the halftone process, the image data 90 in the bit mapped format is converted into data having four gradations for one pixel. The error diffusion method or the dither method is utilized in the halftone process. Since these methods are known, they will not be described in detail here. The image data 90 after the halftone process is stored in the work area 70 of the RAM 68. The image data 90 prior to the halftone process is erased from the RAM 68.

Figure 13:
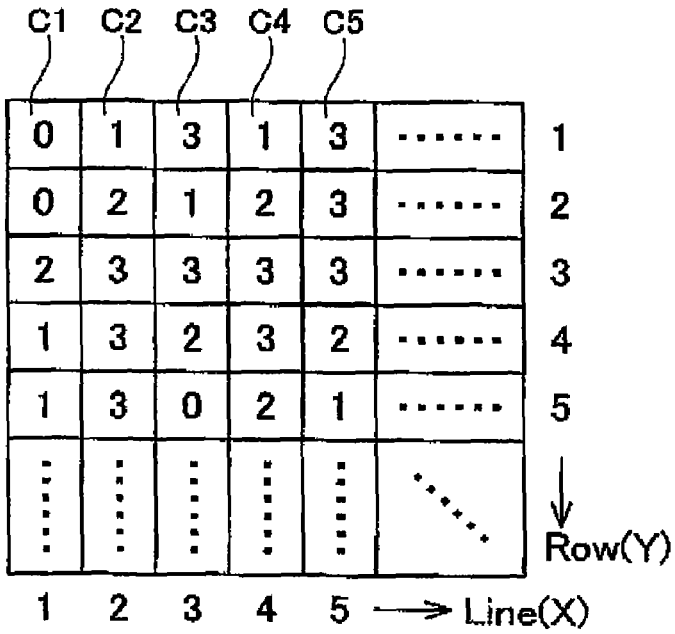
FIG. 13 shows an example of image data

FIG. 13 shows an example of the image data 90 after the halftone process. The image data 90 has a plurality of pixels C1~C5 etc. The number of pixels aligned in the X direction is the same as the resolution of the printer 30 in the X direction. That is, the number of pixels aligned in the X direction is the same as the number of nozzle units of the ink jet head 32. The X direction is a direction orthogonal to the direction in which the printing paper 12 is transported. The number of pixels aligned in the Y direction is the same as the resolution of the printer 30 in the Y direction. The Y direction is the direction in which the printing paper 12 is transported. X and Y in FIG. 13 correspond to X and Y in FIG. 3, etc.

Below, the position of one pixel of the image data 90 is represented as a two dimensional coordinate. For example, the position of the pixel C1 is represented as (1,1). The position of the pixel C2 is represented as (2,1).

Each pixel stores one out of the gradation values 0, 1, 2, 3. The gradation value 0 corresponds to 'no dot.' The gradation value 1 corresponds to 'small dot.' The gradation value 2 corresponds to 'medium dot.' The gradation value 3 corresponds to 'large dot.'

The pixel C1 has a gradation value 0. As a result, the pixel C1 is data having a combination of (1,1) and the gradation value 0. With the pixel C1, no dot is to be formed at the coordinate (1,1) of the printing paper 12. Further, the pixel C2 is data having a combination of (2,1) and the gradation value 1. With the pixel C2, a small dot is to be formed at the coordinate (2,1) of the printing paper 12.

Below, the plurality of pixels aligned in the X direction of the image data 90 is termed one row data. In FIG. 13, five row's worth of one row data is shown.

When the CPU 60 has finished the halftone process, the CPU 60 executes the print data creating process (S804). In the process of S804, print data that includes selected nozzle information is created.

Figure 14:
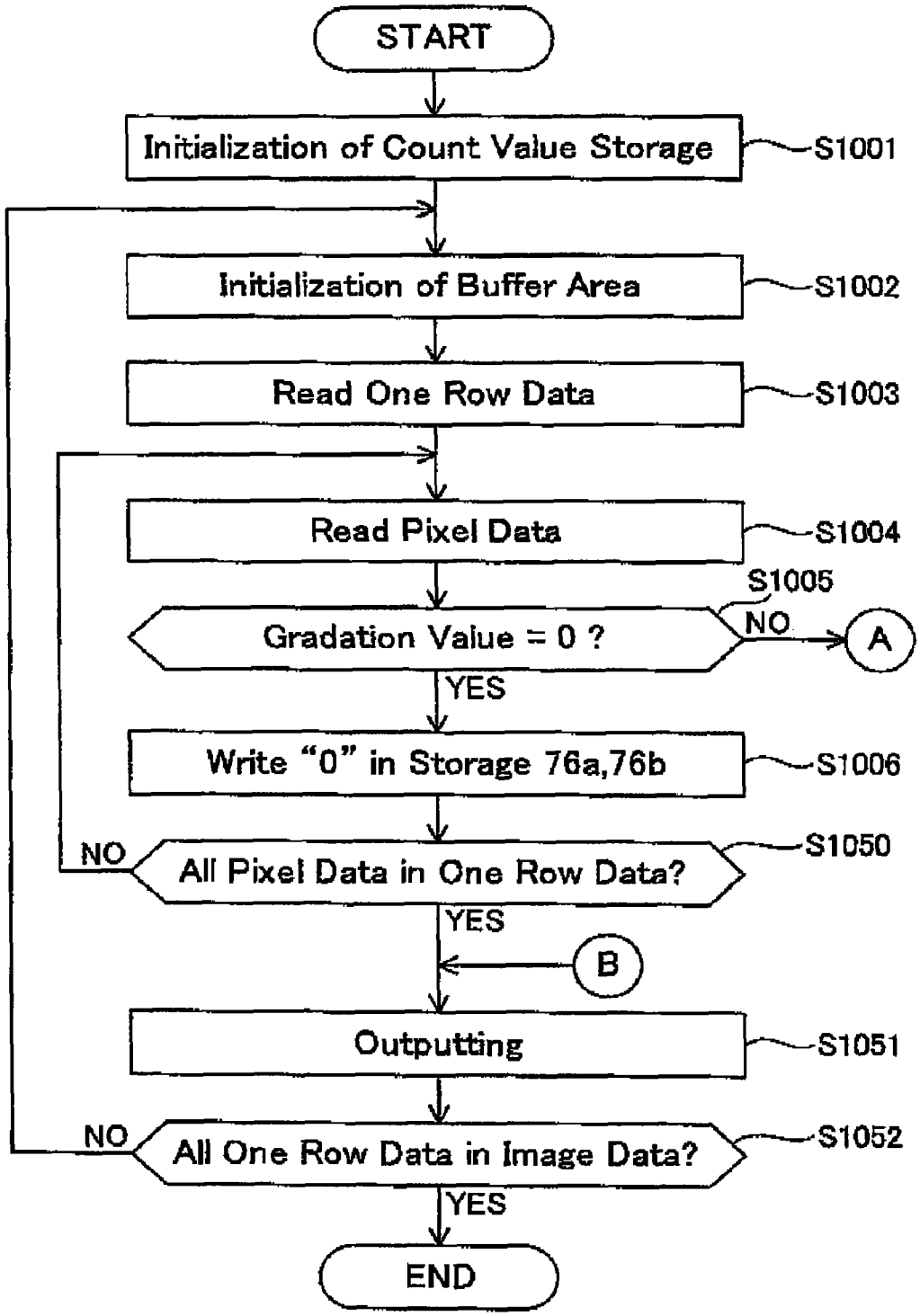
FIG. 14 shows a flowchart of a print data creating process.
Figure 15:
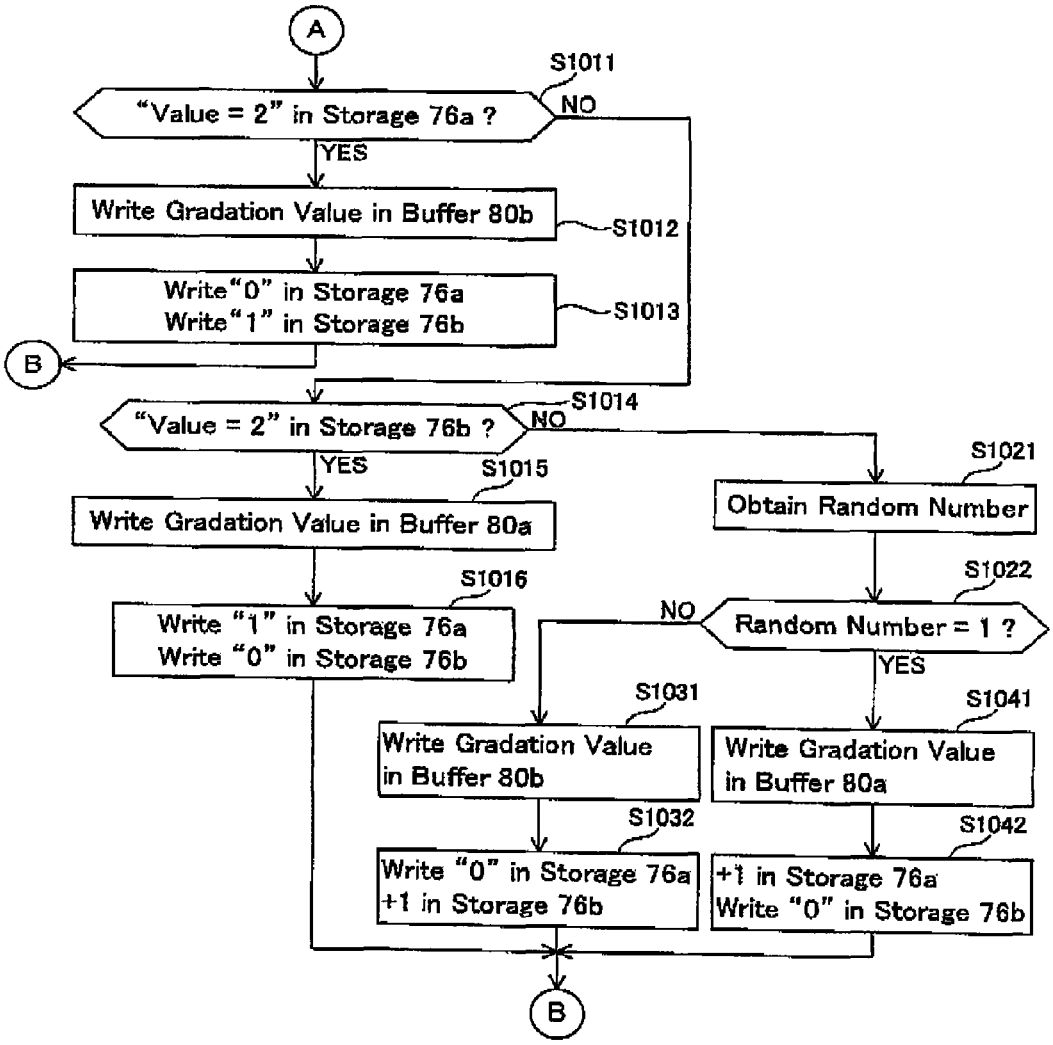
FIG. 15 shows the flowchart of the print data creating process (continued from FIG. 14).

FIGS. 14 and 15 show a flowchart of the print data creating process. The CPU 60 initializes the count value storages 76*a* and 76*b* (S1001). In S1001, 0 is written into all of the cells 76*a*-1~76*a*-*n* (see FIG. 9) in the first count value storage 76*a*. Further, 0 is written into all of the cells 76*b*-1~76*b*-*n* (see FIG. 9) in the second count value storage 76*b*.

Next, the CPU 60 initializes the buffer areas 80*a* and 80*b* of the RAM 68 (S1002). In S1002, 0 is written into all of the cells 80*a*-1~80*a*-*n* (see FIG. 10) in the first buffer area 80*a*. Further, 0 is written into all of the cells 80*b*-1~80*b*-*n* (see FIG. 10) in the second buffer area 80*b*.

Next, the CPU 60 reads the one row data (S1003) of the image data 90 (being stored in the work area 70 of the RAM 68) after the halftone process (S803). When the process of S1003 is performed at the first time, a first row of one row data (C1~C5, etc. of FIG. 13) is read.

The one row data that has been read is written into the one row data storage 72 of the RAM 68 (see FIG. 7). The one row data storage 72 of FIG. 8 stores the first row of the one row data of the image data 90 of FIG. 13. The one row data storage 72 stores the one row data in a state that maintains the sequence of the cells of the image data 90. For example, the first row of the one row data of FIG. 13 has the gradation values aligned in the sequence, from left, 0, 1, 3, 1, 3. In this case, the one row data storage 72 also stores the gradation values in this sequence. In FIG. 8, also, these are aligned in the sequence, from left, 0, 1, 3, 1, 3.

In the process of S1003, only one row's worth of the one row data is read. A plurality of row's worth of one row data is not read. When the following processes have been completed for one row's worth of the one row data, the next one row data is read. For example, when the processes have been completed for the first row of the one row data, the second row of the one row data is read. In S1003, the one row data is read in the sequence of alignment in the Y direction of the image data 90.

Next, the CPU 60 reads the gradation value of one pixel (cell) from the one row data in the one row data storage 72 (S1004). The gradation value that has been read is stored in the pixel data storage 74 of the RAM 68.

One pixel is read in the process of S1004. A plurality of pixels is not read. When the following processes have been completed for one pixel, the next pixel is read. In S1004, the pixels are read in the sequence of alignment in the X direction of the one row data. For example, when the processes have been completed for the cell 72-1 of FIG. 8, the cell 72-2 is then read. When the processes have been completed for the cell 72-2, the cell 72-3 is then read.

The CPU determines whether the gradation value stored in the pixel data storage 74 is 0 (S1005). If the gradation value is 0 (YES in S1005), 0 is written (S1006) in the count value storages 76*a* and 76*b* that correspond to the pixel read in S1004. For example, if the cell 72-1 of FIG. 8 is read in S1004, YES is determined in S1005. The cell 72-1 corresponds to the cells 76*a*-1 and 76*b*-1 of FIG. 9. In S1006, 0 is written in both the cells 76*a*-1 and 76*b*-1.

In S1006, nothing is written in the buffer areas 80*a* and 80*b*. The buffer areas 80*a* and 80*b* are initialized in S1002. As a result, the cells of the buffer areas 80*a* and 80*b* that correspond to the pixel read in S1004 remain at 0. For example if the cell 72-1 of FIG. 8 is read in S1004, 80*a*-1 and 80*b*-1 of FIG. 10 remain at 0.

When S1006 ends, the CPU 60 determines whether all the processes have been completed for all the pixels stored in the one row data storage 72 (S1050). In the case where NO is determined, the process returns to S1004, and the CPU 60 reads the next pixel. For example, if the process for the cell 72-1 of FIG. 8 has been completed, the cell 72-2 is read.

However, if NO was determined in S1005, the process proceeds to S1011 of FIG. 15. For example, in the case where the cell 72-2 of FIG. 8 has been read in S1004, the gradation value of the cell 72-2 is 1, and consequently NO is determined in S1005. In this case, the processes after S1011 are executed.

In S1011 of FIG. 15, the CPU 60 determines whether 2 is stored in the cell of the first count value storage 76*a* that corresponds to the pixel read in S1004. That is, in the case where the cell 72-*n* of FIG. 8 has been read in S1004, the value of the cell 76*a*-*n* of FIG. 9 is checked in S1011. For example, if the cell 72-2 of FIG. 8 has been read in S1004, the value of the cell 76*a*-2 of FIG. 9 is checked in S1011.

If YES was determined in S1011, the CPU 60 writes the gradation value of the pixel read in S1004 into the cell of the second buffer area 80*b* that corresponds to this pixel (S1012). That is, in the case where the gradation value of the cell 72-*n* of FIG. 8 has been read in S1004, the CPU 60 writes that graduation value into the cell 80*b*-*n* of FIG. 10 in S1012. For example, in the case where the cell 72-2 (gradation value 3) of FIG. 8 has been read in S1004, 1 is written into the cell 80*b*-2 of FIG. 10 in S1012.

When S1012 has been completed, the process proceeds to S1013. The CPU 60 writes 0 in the cell of the first count value storage 76*a* that corresponds to the pixel read in S1004. That is, if the cell 72-*n* of FIG. 8 has been read in S1004, the CPU 60 writes 0 in the cell 76*a*-*n* of FIG. 9 in S1013. Further, the CPU 60 writes I in the cell of the second count value storage 76*b* that corresponds to the pixel read in S1004. That is, if the cell 72-*n* of FIG. 8 has been read in S1004, the CPU 60 writes 1 in the cell 76*a*-*n* of FIG. 9 in S1013.

When S1013 has been completed, the process proceeds to S1050 (see FIG. 14).

If NO was determined in S1011, the process proceeds to S1014. The CPU 60 determines whether 2 is stored in the cell of the second count value storage 76*b* corresponding to the pixel read in S1004. That is, in the case where the cell 72-*n* of FIG. 8 has been read in S1004, the value of the cell 76*b*-*n* of FIG. 9 is checked in S1014.

If YES was determined, the CPU 60 writes the gradation value of the pixel read in S1004 into the cell of the first buffer area 80*a* that corresponds to this pixel (S1015). That is, in the case where the gradation value of the cell 72-*n* of FIG. 8 has been read in S1004, the CPU 60 writes that graduation value into the cell 80*a*-*n* of FIG. 10 in S1015.

When S1015 has been completed, the process proceeds to S1016. The CPU 60 writes 1 in the cell of the first count value storage 76*a* that corresponds to the pixel read in S1004. That is, if the cell 72-*n* of FIG. 8 has been read in S1004, the CPU 60 writes 1 in the cell 76*a*-*n* of FIG. 9 in S1016. Further, the CPU 60 writes 0 in the cell of the second count value storage 76*b* that corresponds to the pixel read in S1004. That is, if the cell 72-*n* of FIG. 8 has been read in S1004, the CPU 60 writes 0 in the cell 76*b*-*n* of FIG. 9 in S1016.

When S1016 has been completed, the process proceeds to S1050 (see FIG. 14).

If NO was determined in S1014, the CPU 60 randomly obtains either 1 or 2 (S1021). The random number 1 or 2 is created in the work area 70 of the RAM 68.

The CPU 60 checks whether the random number obtained in S1021 is 1 (S1022). If NO is determined (if the random number is 2), the CPU 60 writes the gradation value of the pixel read in S1004 into the cell of the second buffer area 80*b* that corresponds to this pixel (S1031). That is, in the case where the gradation value of the cell 72-*n* of FIG. 8 has been read in S1004, the CPU 60 writes that graduation value into the cell 80*b*-*n* of FIG. 10 in S1031.

When S1031 has been completed, the process proceeds to S1032. The CPU 60 writes 0 in the cell of the first count value storage 76*a* that corresponds to the pixel read in S1004. That is, if the cell 72-*n* of FIG. 8 has been read in S1004, the CPU 60 writes 0 in the cell 76*a*-*n* of FIG, 9 in S1032. Further, the CPU 60 adds 1 to the value of the cell of the second count value storage 76*b* that corresponds to the pixel read in S1004. That is, if the cell 72-*n* of FIG. 8 has been read in S1004, the CPU 60 adds 1 to the value of the cell 76*b*-*n* of FIG. 9 in S1032. For example, if the value in the cell 76*b*-*n* was 0, the value of the cell 76*b*-*n* becomes 1. As another example, if the value in the cell 76*b*-*n* was 1, the value of the cell 76*b*-*n* becomes 2. Moreover, if the value in the cell 76*b*-*n* was 2, YES was determined in S1014, and consequently the process would not have proceeded to S1032.

When S1032 has been completed, the process proceeds to S1050 (see FIG. 14).

If YES was determined in S1022 (if the random number was 1), the CPU 60 writes the gradation value of the pixel read in S1004 into the cell of the first buffer area 80*a* that corresponds to his pixel (S1041). That is, in the case where the gradation value of the cell 72-*n* of FIG. 8 has been read in S1004, the CPU 60 writes that graduation value into the cell 80*a*-*n* of FIG. 10 in S1041.

When S1041 has been completed, the process proceeds to S1042. The CPU 60 adds 1 to the value of the cell of the first count value storage 76*a* that corresponds to the pixel read in S1004. That is, if the cell 72-*n* of FIG. 8 has been read in S1004, the CPU 60 adds 1 to the value of the cell 76*a*-*n* of FIG. 9 in S1042. For example, if the value in the cell 76*a*-*n* was 0, the value of the cell 76*a*-*n* becomes 1. As another example, if the value in the cell 76*a*-*n* was 1, the value of the cell 76*a*-*n* becomes 2. Moreover, if the value in the cell 76*a*-*n* was 2, YES was determined in S1011, and consequently the process would not have proceeded to S1042. Further, the CPU 60 writes 0 in the cell of the second count value storage 76*b* that corresponds to the pixel read in S1004. That is, if the cell 72-*n* of FIG. 8 has been read in S1004, the CPU 60 writes 0 in the cell 76*b*-*n* of FIG. 9 in S1042.

When S1042 has been completed, the process proceeds to S1050 (see FIG. 14).

In S1050 of FIG. 14, the CPU 60 determines whether the processes have been executed for all the pixels of the one row data. In the case where NO is determined, the process returns to S1004, and the next pixel is read.

In the case where YES is determined, the process proceeds to S1051. In S1051, the CPU 60 outputs the contents of the buffer areas 80*a* and 80*b* to the printer 30. At the point when S1051 is executed, the gradation values of all the pixels of the one row data have been sorted into either of the buffer areas 80*a* and 80*b*.

Figure 16:
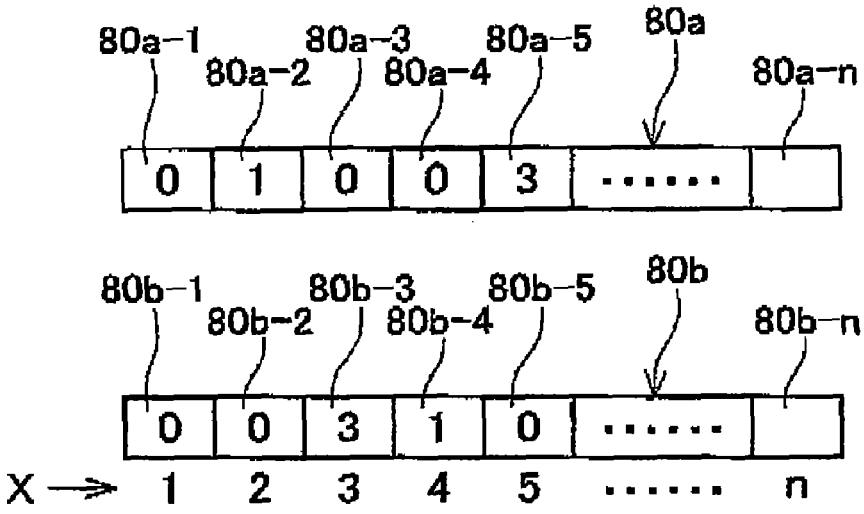
FIG. 16 shows the buffer areas in which selected nozzle information has been written.

In the present embodiment, the content stored in the buffer areas 80*a* and 80*b* is termed the print data. FIG. 16 shows the print data corresponding to the one row data of FIG. 8. Since the gradation value of the cell 72-1 of FIG. 8 is 0, the cells 80*a*-1 and 80*b*-1 of FIG. 16 both store 0. Further, the gradation value of the cell 72-2 of FIG. 8 is 1. The gradation value 1 of the cell 72-2 is sorted into either of the cells 80*a*-2 and 80*b*-2. In the example of FIG. 16, 1 is stored in the cell 80*a*-2 and 0 is stored in the cell 80*b*-2. Further, the gradation value of the cell 72-3 of FIG. 8 is 3, the gradation value of the cell 72-4 is 1, and the gradation value of the cell 72-5 is 3. This information is also sorted into either of the buffer areas 80*a* and 80*b*. That is, in the example of FIG. 16, the cell 80*b*-3 stores 3, the cell 80*b*-4 stores 1, and the cell 80*a*-5 stores 3.

In S1051, the CPU 60 outputs one row's worth of the print data (the contents stored in the buffer areas 80*a* and 80*b*) to the printer 30. The manner in which the print data is utilized by the printer 30 will be described later.

After S1051 has been completed, the CPU 60 determines whether the processes have been completed for all the one row data included in the image data 90 (S1052). If NO is determined in S1052, the process returns to S1002 and the processes for the next one row data are executed.

If YES is determined in S1052, the print data creating process ends.

Next, the process for executing the printer 30 will be described. The print data output from the PC 20 in the process of S1051 is input to the printer 30. The CPU 100 of the printer 30 controls the ink jet head 32 and the transferring device 104 (see FIG. 7) based on the input print data The CPU 100 causes ink to be discharged from the nozzles 34*a-n* in accordance with the content of the cells 80*a-n* of FIG. 16. For example, since the gradation value of the cell 80*a*-1 of FIG. 16 is 0, the CPU 100 does not cause ink to be discharged from the nozzle 34*a*-1. As another example, since the gradation value of the cell 80*a*-2 is 1, the CPU 100 causes ink to be discharged from the nozzle 34*a*-2. Here, a quantity of ink is discharged for forming a small dot. As another example, since the gradation value of the cell 80*a*-2 is 3, the CPU 100 causes ink to be discharged from the nozzle 34*a*-5. Here, a quantity of ink is discharged for forming a large dot. Further, the CPU 100 causes ink to be discharged from the nozzles 34*b-n* in accordance with the content of the cells 80*b-n* of FIG. 16. For example, since the gradation value of the cell 80*b*-1 of FIG. 16 is 0, the CPU 100 does not cause ink to be discharged from the nozzle 34*b*-1. As another example, since the gradation value of the cell 80*b*-3 is 3, the CPU 100 causes ink to be discharged from the nozzle 34*b*-3. Here, a quantity of ink is discharged for forming a large dot.

Moreover, the CPU 100 causes ink to be discharged from the nozzles simultaneously For example, in the example of FIG. 16, ink is discharged simultaneously from the nozzles 34*a*-2, 34*b*-3, 34*b*-4, and 34*a*-5. As a result, a plurality of dots aligned in the X direction are formed simultaneously on the printing paper 12.

The CPU 100 forms the dots based on one row's worth of print data, then drives the transferring device 104 so as to transport the printing paper 12. The printing paper 12 is transported by a distance corresponding to the resolution of the printer 30 in the Y direction. When the CPU 100 transports the printing paper 12, the CPU 100 waits for the next row's worth of print data to be output from the PC 20. The CPU 100 repeatedly executes the process of forming dots based on one row's worth of print data and the process of transporting the printing paper 12. An image corresponding to the image data 90 is thus printed on the entire range of the printing paper 12.

As described above, the CPU 100 discharges ink from the nozzles based on the information in the cells of the print data. In the example of FIG. 16, the gradation value of both the cell 80*a*-1 and the cell 80*b*-1 is 0, and therefore ink is discharged from neither the nozzle 34*a*-1 nor the nozzle 34*b*-1. That is, in the case of this one row's worth of print data, neither of the nozzles for discharging ink from the nozzle unit 34-1 has been selected by the PC 20.

However, the gradation value of the cell 80*a*-2 of FIG. 16 is 1, and consequently ink is discharged from the nozzle 34*a*-2, and is not discharged from the nozzle 34*b*-2. That is, the nozzle 34*a*-2 of the nozzle unit 34-2 has been selected by the PC 20. Further, the gradation value of the cell 80*b*-3 of FIG. 16 is 3, and consequently ink is discharged from the nozzle 34*b*-3, and is not discharged from the nozzle 34*a*-3. That is, the nozzle 34*b*-3 of the nozzle unit 34-3 has been selected by the PC 20.

The print data includes a plurality of combinations of position where the dot is to be formed, one nozzle selected from the nozzles of the nozzle unit corresponding to that position, and the ink quantity to be discharged from that nozzle. For example, in the example of FIG. 16, when 1 is stored in the cell 80*a*-2, this signifies the combination 'X~2', 'the nozzle 34*a*-2' and 'ink quantity for forming a small dot.' It might seem that position in the Y direction is not stored in this information. However, the position of the image data 90 in the Y direction is retained in the sequence in which the print data is sent. The PC 20 creates print data that is mapped to positions in the Y direction by creating this print data in the sequence of the Y direction.

In the present embodiment, the combination of position, selected nozzle, and ink quantity included in the print data is also termed the selected nozzle information. That is, the print data includes a plurality of items of selected nozzle information.

The PC 20 basically selects one nozzle at random utilizing a random number (see S1021~S1042 of FIG. 15). That is, the PC 20 randomly selects one nozzle from the nozzles of one nozzle unit, thus creating the selected nozzle information.

However, the PC 20 counts the number of times that the same nozzle of each nozzle unit has formed dots. For example, in the case where the nozzle 34*a*-1 has formed a dot when 0 is stored in the cell 76*a*-1 of the first count value storage 76*a*, 1 is written in the cell 76*a*-1 (S1042). Further, in the case where the nozzle 34*a*-1 has formed a dot when 1 is stored in the cell 76*a*-1 of the first count value storage 76*a*, 2 is written in the cell 76*a*-1 (S1042). Random selection is prohibited when 2 is being stored in the cell 76*a*-1, and instead the nozzle 34*b*-1 must be selected (S1012). In this case, the dot is formed by the nozzle 34*b*-1. The nozzle 34*a*-1 is thus prevented from forming three consecutive dots.

The PC 20 prohibits the same nozzle from being selected for more than two positions continuously aligned in the Y direction. As a result, dots are prevented from being formed by the same nozzle at more than two consecutive positions in the Y direction. With the present embodiment, even when nozzles are not aligned equidistantly in the X direction, it is possible to completely eliminate the phenomenon wherein regions in which the ink density is much greater or smaller continue across a wide range in the Y direction. As a result, better printing results can be obtained than the conventional technique.

Furthermore, if dots are formed by the same nozzle at consecutive positions in the Y direction, the following problem may occur.

Figure 17:
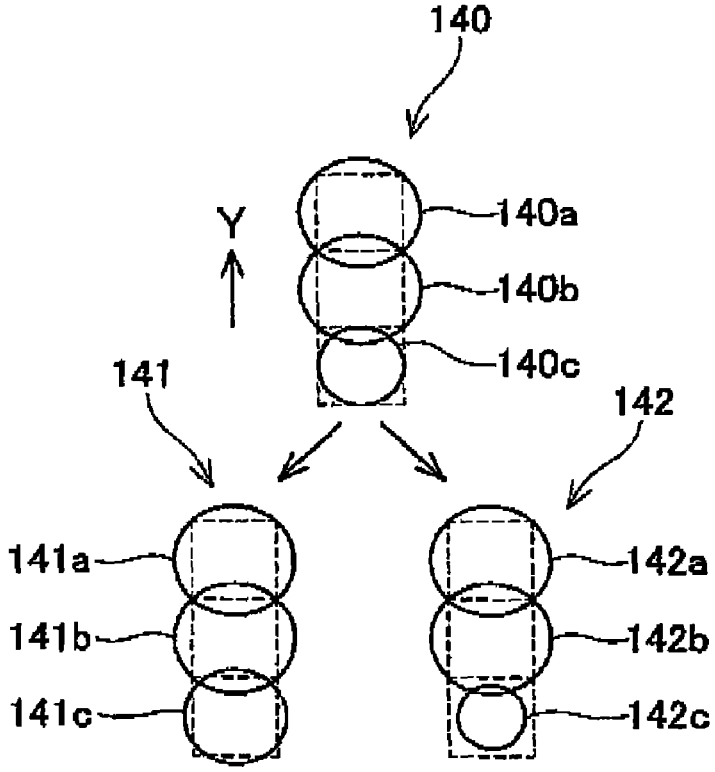
FIG. 17 shows a satisfactory dot pattern, and two types of unsatisfactory dot pattern.
Figure 18:
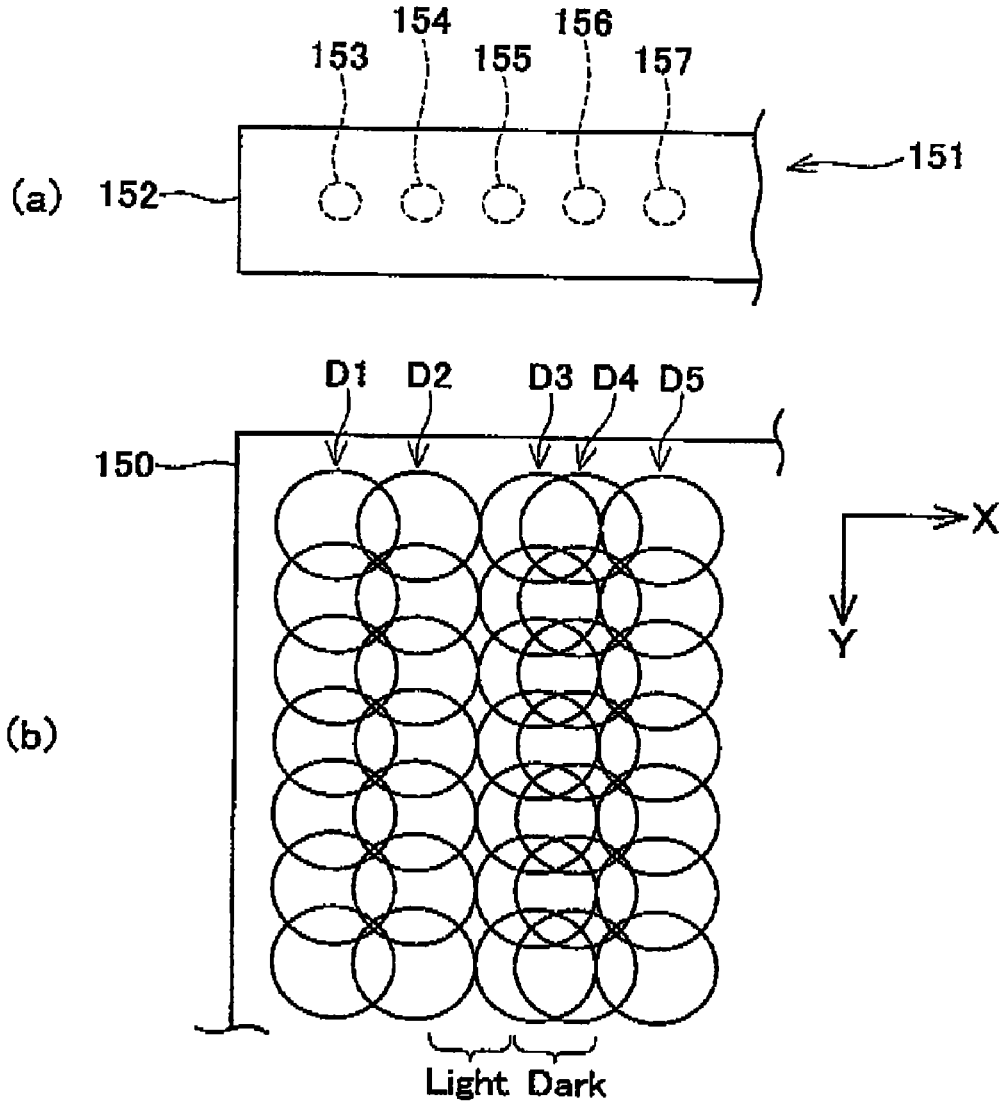
FIG. 18 shows a figure for describing the conventional technique.
Figure 19:
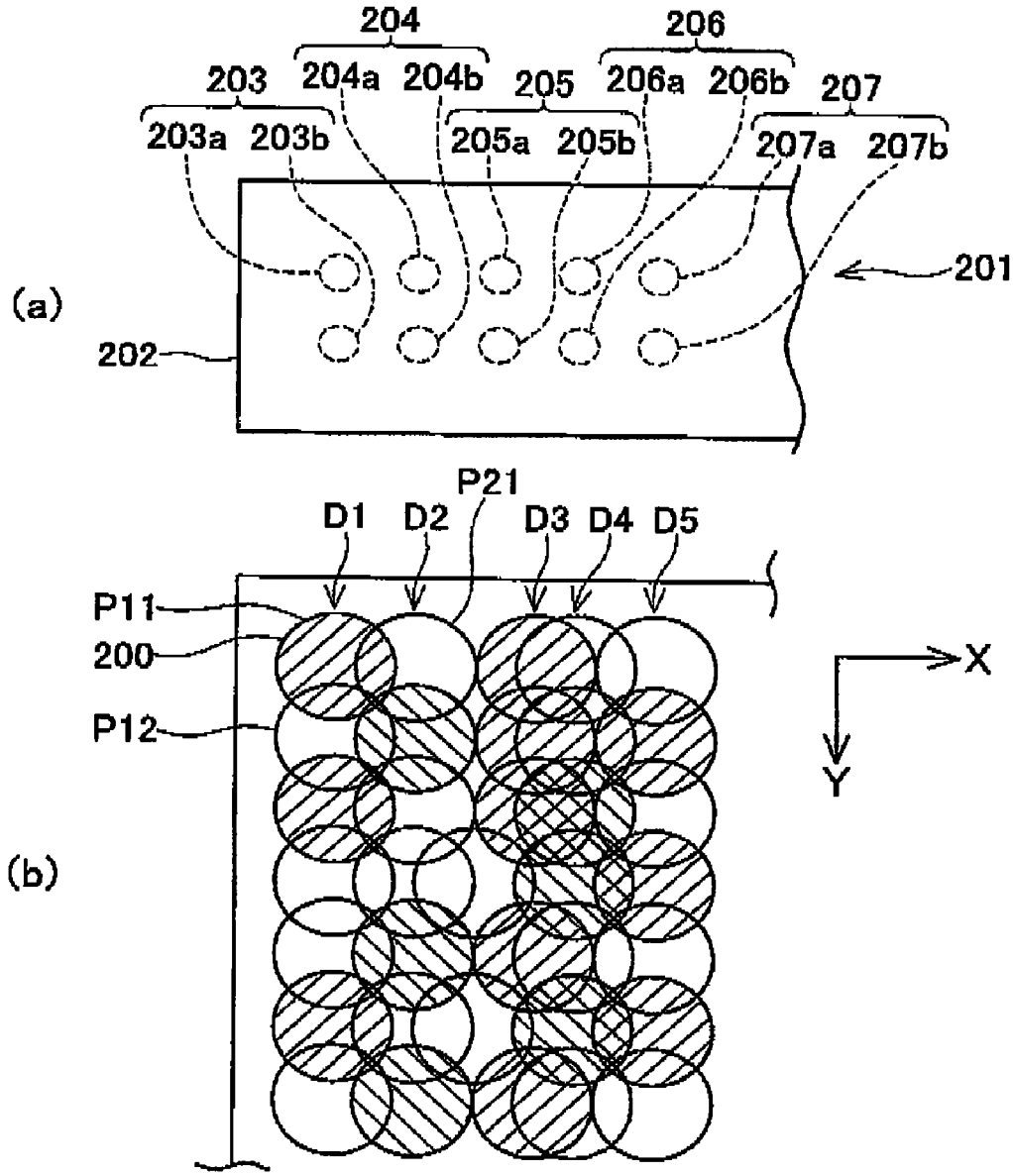
FIG. 19 shows a figure for describing the conventional technique.

Dots 140 of FIG. 17 are aligned in the sequence of a large dot 140*a*, a large dot 140*b*, and a small dot 140*c*. If these dots are formed by the same nozzle, dots 141 or 142 may be formed. With the dots 141, a small dot 141*c* is larger than the small dot 140*c*. With the dots 142, a small dot 142*c* is smaller than the small dot 140*c*.

When dots are formed by the same nozzle at consecutive positions in the Y direction, dots with the intended size might not be obtained. With the present embodiment, dots are prevented from being formed by the same nozzle at more than two consecutive positions in the Y direction, As a result, the above type of problem does not readily occur. Satisfactory printing results can therefore be obtained Variants of the above embodiment are given below.

(1) The technique of the above representative embodiment can also be utilized by a serial type ink jet printer.

(2) The nozzles of the nozzle line 34*a* may also discharge ink in a vertical direction (see FIG. 5). In this case, the timing at which ink is discharged from the nozzles of the nozzle line 34*a* may vary from the timing at which ink is discharged from the nozzles of the nozzle line 34*b*. The nozzle line 34*a* and the nozzle line 34*b* can thus form dots at the same positions.

(3) The number of nozzles in one nozzle unit is not limited to two. The number can be changed to three or more.

(4) In the above representative embodiment, the maximum number of times the same nozzle can be selected consecutively was two times. However, the maximum number of times can be changed to three or more. Of course, the maximum number of times the same nozzle can be selected consecutively is a number smaller than the resolution (the number of dots that can be formed in the Y direction) of the printer 30 in the Y direction. Further, the maximum number may be one when the number of nozzles in one nozzle unit is more than three.

It is preferred that the maximum number of times the same nozzle can be selected consecutively is a small number For example, it is preferred that this number is set to be less than 10 times. The maximum number of times may equally well be set based on the resolution (dpi (dots per inch)) in the Y direction.

(5) The maximum number of times the same nozzle can be selected consecutively need not be fixed at two times. For example, the maximum number may be set as two times in the case of processing one item of image data, and may be set as a number other Man two times in the case of processing a different item of image data. Further, the maximum number of times may be changed to a number other than two while one item of image data is being processed.

(6) In the above representative embodiment, a case was described in which the ink jet printer 30 utilizes only one color of ink. However, the technique of the above representative embodiment can also be utilized by an ink jet printer utilizing a plurality of colors of ink. For example, an ink jet printer utilizing four colors of ink has four ink jet heads. In this case, the PC 20 creates the image data shown in FIG. 13 for each of the colors.

(7) Furthermore, in the above representative embodiment, the PC 20 creates the print data. However, the printer 30 may equally well create the print data. In this case, the reading device 120, the selected nozzle information creating device 122, and the counter 124 of FIG. 11 are mounted in the printer 30. In this case, the following type of variant can be obtained.

For example, the printer 30 may have a scanner function, and may be able to print an image that has been scanned. In this case, the printer 30 creates print data from bit mapped data obtained from the scanned image, and executes a printing operation based on the print data that has been created.

What is claimed is:

1. A computer readable medium having instructions stored thereon, the instructions for creating print data utilized by an ink jet printer to print ink on a print medium, the ink jet printer comprising an ink jet head moving along a predetermined direction with respect to said print medium, the ink jet head comprising a plurality of nozzle units, each nozzle unit comprising at least two nozzles aligned along the predetermined direction, the nozzles being capable of discharging ink of the same color, and each nozzle unit being capable of forming one dot on the print medium by discharging the ink from one nozzle selected from the nozzles of the nozzle unit, the instructions ordering a computer to perform:

a reading step of reading image data including a plurality of first combinations, each first combination comprising a position and information concerning whether the dot is to be formed at the position; and a print data creating step of creating the print data by creating a second combination for each position at which the dot is to be formed, each second combination comprising the position at which the dot is to be formed and one nozzle randomly selected from the nozzles of the nozzle unit which corresponds to the position, wherein in the print data creating step, it is prohibited to select the same nozzle for more than a predetermined number of positions continuously aligned along the predetermined direction.

2. The computer readable medium as in claim 1, wherein in the print data creating step, each second combination is created in accordance with the alignment order of each position along the predetermined direction.

3. A computer readable medium as in claim 2, the instructions for ordering the computer to further perform:

a counting step of counting a number of times that the same nozzle was continuously selected for each nozzle unit.

4. The computer readable medium as in claim 1, wherein each first combination comprises the position, the information concerning whether the dot is to be formed at the position, and ink quantity, and each second combination comprises the postion at which the dot is to be formed the one nozzle randomly selected from the nozzles of the nozzle unit which corresponds to the position, and the ink quantity that was combined with the position in the image data.

5. The computer readable medium as in claim 1, wherein the computer is configured separately from the ink jet printer, and the instructions for ordering the computer to further perform;

an outputting step of outputting the print data to the ink jet printer.

6. A device for creating print data utilized by an ink jet printer to print ink on a medium, the ink jet printer comprising an ink jet head moving along a predetermined direction with respect to said print medium, the ink jet head comprising a plurality of nozzle units, each nozzle unit comprising at least two nozzles aligned along the predetermined direction, the nozzles being capable of discharging ink of the same color, each nozzle unit being capable of forming one dot on the print medium by discharging the ink from on nozzle selected from the nozzles of the nozzle unit, the device comprising:

a reading device for reading image data including a plurality of first combinations, each first combination comprising a position and information concerning whether the dot is to be formed the position; and a print data creating device for creating the print data by creating a second combination for each position at which the dot is to be formed, each second combination comprising the position at which the dot is to be formed and one nozzle randomly selected from the nozzles of the nozzle unit which corresponds to the position, wherein the print data creating device creates the print data such that it is prohibited to select the same nozzle for more than a predetermined number of positions continuously aligned along the predetermined direction.

7. A method of creating print data utilized by an ink jet printer, the ink jet printer comprising an ink jet head moving along a predetermined direction with respect to a print medium, the ink jet head comprising a plurality of nozzle units, each nozzle unit comprising at least two nozzles aligned along the predetermined direction, the nozzles being capable of discharging ink of the same color, each nozzle unit being capable of forming one dot on the print medium by discharging the ink from one nozzle selected from the nozzles of the nozzle unit, the method comprising:

a reading step of reading image data including a plurality of first combinations, each first combination comprising a position and information concerning whether the dot is to be formed at the position; and a print data creating step of creating the print data by creating a second combination for each position at which the dot is to be formed, each second combination comprising the position at which the dot is to be formed and one nozzle randomly selected from the nozzles of the nozzle unit which corresponds to the position, wherein in the print data creating step, it is prohibited to select the same nozzle for more than a predetermined number of positions continuously aligned along the predetermined direction.

* * * * *